US010781700B2

(12) United States Patent
Yagi et al.

(10) Patent No.: US 10,781,700 B2
(45) Date of Patent: Sep. 22, 2020

(54) TURBINE ROTOR BLADE ASSEMBLY

(71) Applicant: MITSUBISHI HEAVY INDUSTRIES COMPRESSOR CORPORATION, Tokyo (JP)

(72) Inventors: Nobuyori Yagi, Tokyo (JP); Naoyuki Nagai, Tokyo (JP); Shin Yanagisawa, Tokyo (JP); Yuki Nakamura, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 149 days.

(21) Appl. No.: 16/082,874

(22) PCT Filed: Mar. 6, 2017

(86) PCT No.: PCT/JP2017/008847
§ 371 (c)(1),
(2) Date: Sep. 6, 2018

(87) PCT Pub. No.: WO2017/154852
PCT Pub. Date: Sep. 14, 2017

(65) Prior Publication Data

US 2019/0078447 A1 Mar. 14, 2019

(30) Foreign Application Priority Data

Mar. 8, 2016 (JP) ..... 2016-043979

(51) Int. Cl.
*F01D 5/22* (2006.01)
*F01D 5/16* (2006.01)
(Continued)

(52) U.S. Cl.
CPC ..... *F01D 5/225* (2013.01); *F01D 5/16* (2013.01); *F01D 5/20* (2013.01); *F01D 5/3007* (2013.01);
(Continued)

(58) Field of Classification Search
CPC ..... F01D 5/225; F05D 2260/96
See application file for complete search history.

(56) References Cited

U.S. PATENT DOCUMENTS 1,423,466 A * 7/1922 Snyder ..... F01D 5/225 416/191
2012/0195766 A1* 8/2012 Cohin ..... F01D 5/225 416/241 A
(Continued)

FOREIGN PATENT DOCUMENTS

DE 606351 C 11/1934
EP 1873355 A1 * 1/2008 ..... F01D 5/225
(Continued)

OTHER PUBLICATIONS

International Search Report issued in corresponding International Application No. PCT/JP2017/008847 dated May 16, 2017 (2 pages).
(Continued)

*Primary Examiner* — Nathaniel E Wiehe
*Assistant Examiner* — Ryan C Clark
(74) *Attorney, Agent, or Firm* — Osha Liang LLP

(57) ABSTRACT

In a turbine rotor blade assembly 1 of the present invention, each turbine rotor blade 10 includes a platform 11 having a blade root 12 fixed to a turbine disk 30, a profile 13 rising from the platform 11, and a shroud 14 provided at a top end of the profile 13. The shroud 14 of the present invention includes a first contact end part 15 that comes into contact with an adjacent shroud adjacent to one end side in a circumferential direction, a second contact end part 16 that
(Continued)

comes into contact with an another adjacent shroud adjacent to the other end side in the circumferential direction, and a main body part disposed between the first and second contact end parts 15 and 16. One or both of the first and second contact end parts 15 and 16 are lower in rigidity than the main body part.

8 Claims, 7 Drawing Sheets

(51) Int. Cl.
*F01D 5/20* (2006.01)
*F01D 5/30* (2006.01)

(52) U.S. Cl.
CPC .... *F05D 2240/307* (2013.01); *F05D 2250/12* (2013.01); *F05D 2250/191* (2013.01); *F05D 2250/192* (2013.01); *F05D 2250/193* (2013.01); *F05D 2250/291* (2013.01); *F05D 2250/292* (2013.01); *F05D 2250/294* (2013.01); *F05D 2250/72* (2013.01); *F05D 2260/96* (2013.01); *F05D 2300/501* (2013.01); *F05D 2300/506* (2013.01)

(56) References Cited

U.S. PATENT DOCUMENTS

| | | | | |
|---|---|---|---|---|
| 2014/0140841 | A1 | 5/2014 | Gumpina et al. | |
| 2015/0064010 | A1* | 3/2015 | Zhang | F01D 5/186 416/189 |
| 2015/0345310 | A1* | 12/2015 | Davidson | F01D 5/28 60/805 |
| 2016/0258294 | A1* | 9/2016 | Weinert | F01D 5/081 |
| 2016/0369643 | A1* | 12/2016 | Kitagawa | F01D 15/10 |

FOREIGN PATENT DOCUMENTS

| | | | | | |
|---|---|---|---|---|---|
| EP | 1873355 | A1 | | 1/2008 | |
| JP | S61-132703 | A | | 6/1986 | |
| JP | H08-144705 | A | | 6/1996 | |
| JP | 09133003 | A | * | 5/1997 | F01D 5/225 |
| JP | 2001-200703 | A | | 7/2001 | |
| JP | 2002-349204 | A | | 12/2002 | |
| JP | 2014-101880 | A | | 6/2014 | |

OTHER PUBLICATIONS

International Preliminary Report on Patentability issued in corresponding International Application No. PCT/JP2017/008847 dated Sep. 20, 2018 (7 pages).

* cited by examiner

TURBINE ROTOR BLADE ASSEMBLY

TECHNICAL FIELD

The present invention relates to a turbine rotor blade assembly.

BACKGROUND ART

A steam turbine that converts, for example, thermal energy generated by thermal power into mechanical energy through working gas has been operated. The steam turbine includes stationary blades and rotor blades in casings. As the rotor blades, a plurality of ISBs (Integral Shroud Blades) provided on an outer periphery of a rotor disk are coupled (e.g., Patent Literatures 1 to 3). The rotor blades configured by the ISBs (hereinafter, ISB rotor blades) contribute to improvement of vibration strength of the rotor blades through coupling of the blades.

Each of the ISBs includes a platform, a blade root, a profile, and a shroud. The blade root extends from the platform inward in a radial direction of the rotor disk and is embedded in and fixed to the rotor disk. The profile extends from the platform outward in the radial direction. The shroud is provided at a top end of the profile.

The ISBs are coupled with use of centrifugal force loaded during operation of the steam turbine. In other words, the rotor blades are each inclined in a predetermined direction at the time of assembling; however, the rotor blades rise due to the centrifugal force loaded during operation. As a result, the shrouds are brought into a pseudo-integrated structure with use of contact reactive forces that are caused by firm contact of the shrouds adjacent to one another. In the ISB, with respect to a circumferential direction, a pitch of each of the shrouds in an inclined state is set larger than that in a raised state. Accordingly, in a case where an increasing amount of the pitch geometrically obtained is larger than a separating amount of contact surfaces due to the centrifugal force and heat in rotation, the contact surfaces of the shrouds of the ISB adjacent to one another are not separated and the coupled state is maintained during rotation.

CITATION LIST

Patent Literature

Patent Literature 1: JP 2001-200703 A
Patent Literature 2: JP 2002-349204 A
Patent Literature 3: JP 2014-101880 A

SUMMARY OF INVENTION

Technical Problem

To surely realize the coupled state during operation, it is important to secure a contact reactive force from the adjacent shroud to be a contact counterpart. However, nonuniform contact in which the contact surfaces of the contact counterparts to each other are in partial contact with each other may occur due to the shapes, an assembled state, a shape error, etc. of the ISB. This makes the contact reactive forces nonuniform as the whole of the rotor blades, and it is difficult to secure vibration strength.

In consideration of the above, an object of the present invention is to provide a turbine rotor blade assembly that makes it possible to improve uniformity of contact reactive forces between each of shrouds and the shroud as the contact counterpart.

Solution to Problem

The present invention is a turbine rotor blade assembly provided with a plurality of turbine rotor blades in a circumferential direction of a turbine disk. Each of the turbine rotor blades includes a platform having a blade root to be embedded in the turbine disk, a profile rising from the platform, and a shroud provided at a top end of the profile.

The shroud according to the present invention includes a first contact end part that comes into contact with an adjacent shroud adjacent to one end side of the shroud in the circumferential direction, a second contact end part that comes into contact with an another adjacent shroud adjacent to the other end side of the shroud in the circumferential direction, and a main body part disposed between the first contact end part and the second contact end part. In the present invention, one or both of the first contact end part and the second contact end part of the shroud are lower in rigidity than the main body part.

The present invention includes at least the following two modes as a mode in which one or both of the first contact end part and the second contact end part are lower in rigidity than the main body part.

In a first mode, one or both of the first contact end part and the second contact end part include a contact surface that protrudes from the main body part in the circumferential direction and comes into contact with the adjacent shroud, and an area of the contact surface is smaller than an area of a cross-section of the main body part in a width direction.

The contact surface according to the present invention is preferably symmetrical in the width direction, and further preferably protrudes more than concave parts that are provided on both sides of the contact surface in the width direction.

In a second mode, one or both of the first contact end part and the second contact end part communicate with the main body part through a thickness-reducing part.

The thickness-reducing part is preferably formed to extend in the width direction or a height direction.

Advantageous Effects of Invention

According to the present invention, one or both of the first contact end part and the second contact end part are lower in rigidity than the main body part. Therefore, one or both of the first contact end part and the second contact end part elastically deform following the surface shape of a counterpart shroud when coming into contact with the shroud to be the counterpart shroud. This makes it possible to suppress nonuniform contact. Therefore, according to the present invention, it is possible to improve uniformity of the contact reactive force between each of the shrouds and the shroud as the contact counterpart. On the other hand, only a small part of the shroud is enough to contribute to improvement of uniformity of contact, which makes it possible to secure rigidity required as the shroud. As a result, it is possible to obtain a necessary contact reactive force through contact with the adjacent shroud.

Further, according to the first mode of the present invention, a region coming into contact with the counterpart shroud is specified, which makes it possible to more surely suppress nonuniform contact. In addition, according to the first mode, the area of the contact surface where the adjacent shroud is contacted is smaller than the area of the cross-section of the main body part. This makes it possible to enhance surface accuracy of the contact surface, and thereby it is possible to contribute to suppression of nonuniform contact.

In addition, according to the second mode, because the thickness-reducing portion is lower in rigidity than the main body part, the first contact end part located on the top end side of the thickness-reducing part comes into contact with the adjacent shroud. And then, the first contact end part easily elastically deforms following the contact surface of the adjacent shroud. Thereby, nonuniform contact between the contact surfaces of the shrouds adjacent to each other is possible to be surely suppressed.

DESCRIPTION OF EMBODIMENTS

Embodiments of the present invention will be described below with reference to accompanying drawings.

Figure 1:
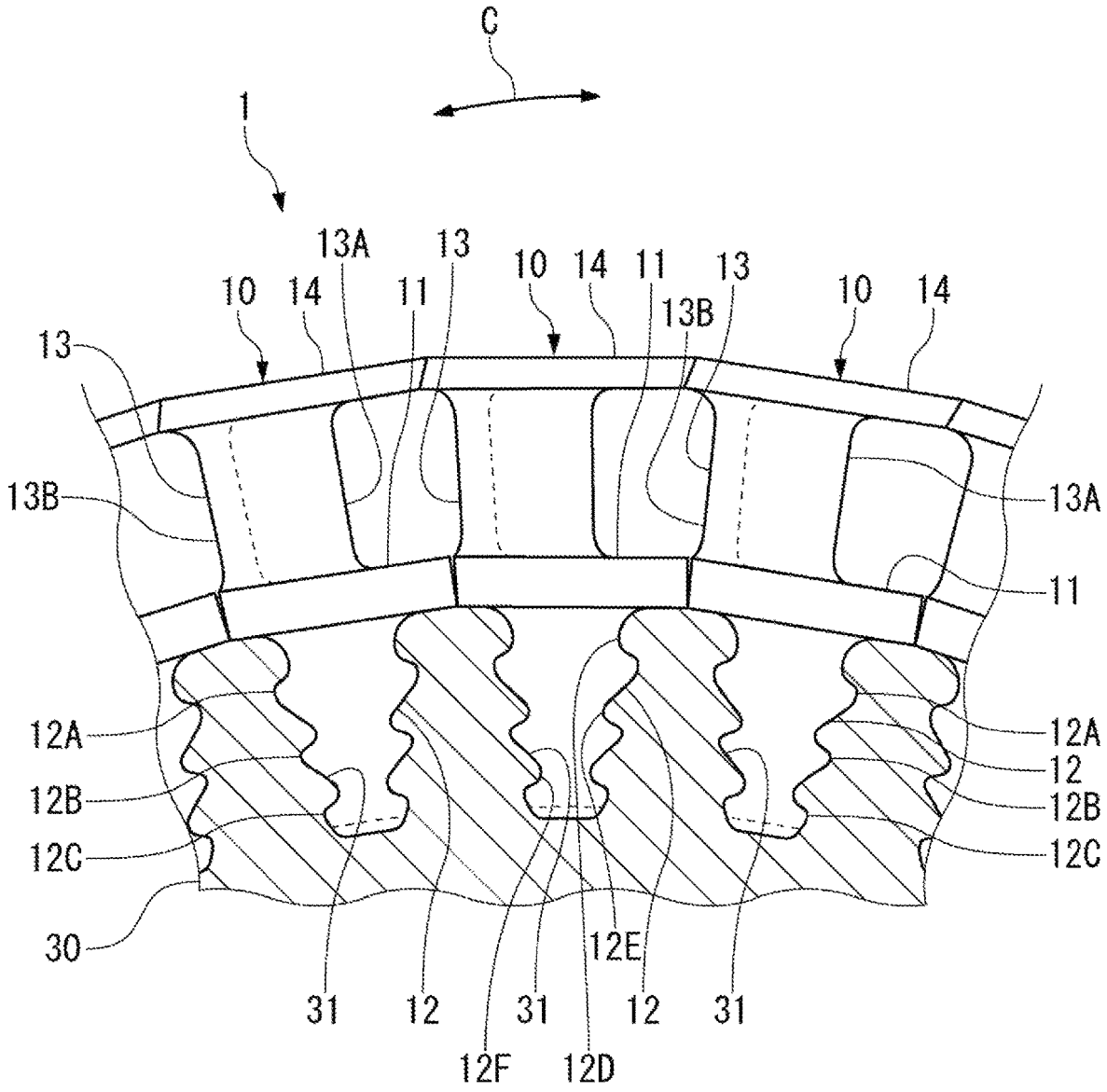
FIG. 1 is a partial cross-sectional view illustrating a turbine rotor blade assembly according to an embodiment of the present invention.

As illustrated in FIG. 1, a turbine rotor blade assembly 1 according to the present embodiment includes a turbine disk 30 and a plurality of turbine rotor blades 10. The turbine disk 30 includes a plurality of blade grooves 31 on an outer periphery thereof. The plurality of turbine rotor blades 10 are respectively held by the blade grooves 31 of the turbine disk 30 and are provided along a circumferential direction C of the turbine disk 30. The turbine rotor blade assembly 1 is used for, for example, a steam turbine that converts thermal energy generated by thermal power into mechanical energy. Although only a part of the turbine rotor blade 1 is illustrated in FIG. 1, the turbine disk 30 has a disk shape, and the plurality of turbine rotor blades 10 are provided over an entire region of the turbine disk 30 in the circumferential direction.

Each of the turbine rotor blades 10 includes a platform 11, a profile 13, and a shroud 14. The platform 11 has a blade root 12 that is inserted into and fixed to the corresponding blade groove 31 of the turbine disk 30. The profile 13 rises from the platform 11 on a side opposite to the side provided with the blade root 12. The shroud 14 is provided at a top end of the profile 13. The platform 11, the blade root 12, the profile 13, and the shroud 14 of each of the turbine rotor blades 10 may be integrally formed. Further, for example, the shroud 14 that is separately fabricated may be joined with the platform 11, the blade root 12, and the profile 13 that are integrally formed.

The platform 11 is a member whose appearance is a substantially rectangular in a planar view. The blade root 12 extends from a rear surface of the platform 11 toward a center in a radial direction in a state where each of the turbine rotor blades 10 is assembled to the turbine disk 30. The blade root 12 according to the present embodiment includes teeth 12A, 12B, and 12C in three stages that are formed toward a top end from a base communicating with the platform 11. The teeth 12A, 12B, and 12C each protrude toward both sides in the circumferential direction C of the turbine disk 30. Further, a tooth space 12D that is recessed more than the platform 11 and the tooth 12A is provided therebetween. A tooth space 12E that is recessed more than the tooth 12A and the tooth 12B is provided therebetween. A tooth space 12F that is recessed more than the tooth 12B and tooth 12C is formed therebetween. Each of the blade grooves 31 of the turbine disk 30 is formed in a shape so as to be engaged with the teeth 12A, 12B, and 12C, and the tooth spaces 12D, 12E, and 12F.

Figure 5A:
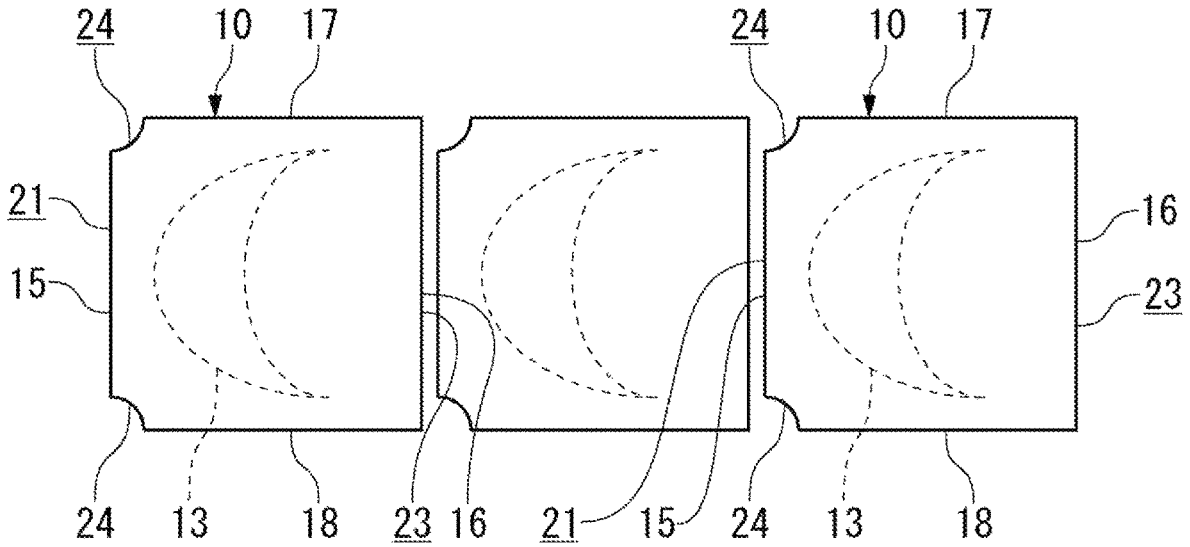
FIG. 5A and FIG. 5B are respectively partial plan views each illustrating the turbine rotor blades according to another embodiment of the present invention.

The profile 13 includes a belly side part 13A and a back side part 13B opposite to the belly side part 13A. The belly side part 13A is recessed toward the back side part 13B, and the profile 13 accordingly has a wing-shaped cross-section (see FIG. 5). The turbine rotor blades 10 each receive steam at the recessed portion of the belly side part 13A to obtain rotational driving force of the turbine disk 30.

The shroud 14 is a substantially rectangular member in a planar view that is provided so as to face the platform 11 beyond the profile 13 therebetween. The shrouds 14 adjacent to one another are brought into a pseudo-integrated structure with use of contact reactive forces that are caused by firm contact of the shrouds 14 adjacent to one another. When the blade roots 12 are respectively embedded in the blade grooves 31 of the turbine disk 30 with respect to the respective turbine rotor blades 10, the platforms 11 are arranged in the circumferential direction C along the outer periphery of the turbine disk 30, and the profiles 13 are radially arranged in the radial direction of the turbine disk 30.

Figure 2A:
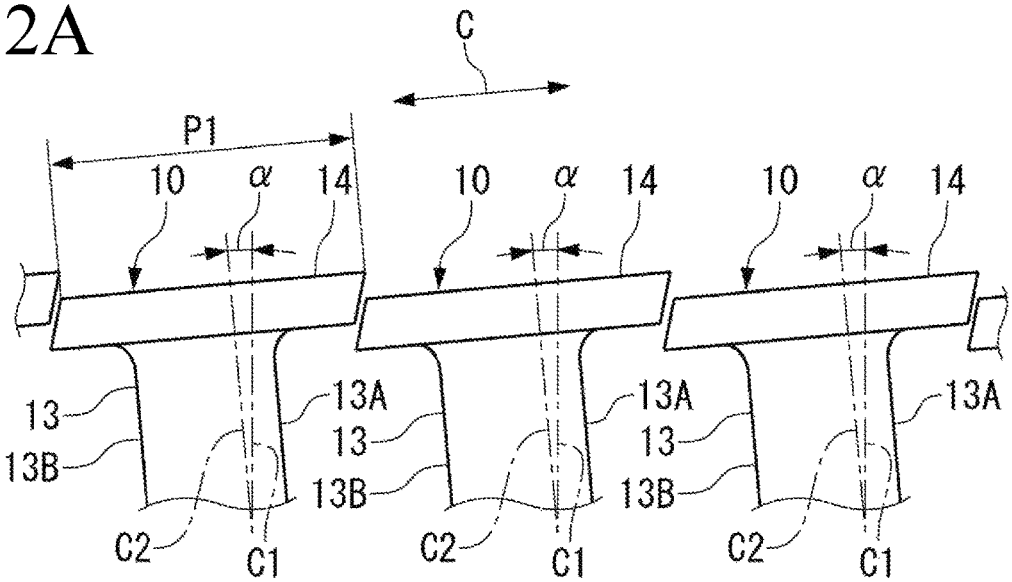
FIG. 2A illustrates an assembled state of the turbine rotor blade assembly according to the embodiment of the present invention.

As illustrated in FIG. 2A, when the turbine rotor blade assembly 1 is assembled, the turbine rotor blade assembly 1 is inclined by a predetermined inclination angle $\alpha$. The inclination angle $\alpha$ in the present embodiment is defined as an angle that is formed by a center line C2 of the blade root 12 with a center line C1 of the blade groove 31.

Figure 2B:
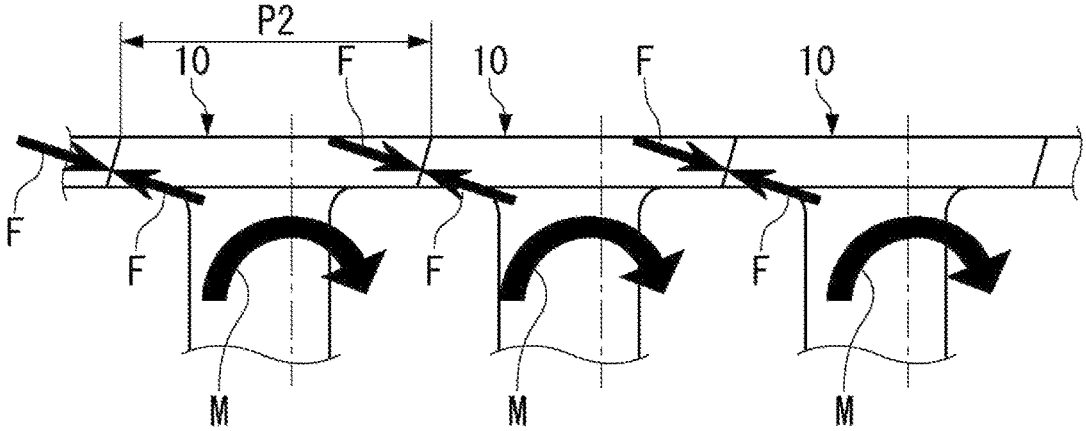
FIG. 2B illustrates an operating state of the turbine rotor blade assembly according to the embodiment of the present invention.

When the turbine rotor blade assembly 1 rotates, rotation moment M occurs from the back side part 13B toward the belly side part 13A on each of the turbine rotor blades 10 due to centrifugal force generated on the turbine rotor blade assembly 1. As a result, the turbine rotor blade assembly 1 is shifted from an inclined state to a raised state illustrated in FIG. 2B. Note that FIG. 2A and FIG. 2B exaggeratingly illustrate the inclination in order to clearly show a state that the turbine rotor blades 10 are inclined.

In this example, a pitch P1 (FIG. 2A) of the shroud 14 of each of the turbine rotor blades 10 in the circumferential direction C is set larger than a pitch P2 (FIG. 2B) in the raised state during operation. Accordingly, when the turbine rotor blades 10 rise, the shrouds 14 are brought into the pseudo-integrated structure with use of the contact reactive force F that is caused by firm contact of the shrouds 14 adjacent to one another, which makes it possible to maintain a coupled state of the rotating turbine rotor blades 10.

To surely realize the coupled state during operation, it is important to secure the contact reactive force from the adjacent shroud 14. In a case where contact surfaces of the shrouds 14 adjacent to one another come into contact only partially with one another, necessary contact pressure is unobtainable. In addition, with respect to a large number of the contact surfaces, if contact regions of them are varied, the contact reactive forces easily become nonuniform. Therefore, the turbine rotor blades 10 according to the present embodiment improve uniformity of the contact reactive forces. This will be described below with reference to FIG. 3.

Figure 3:
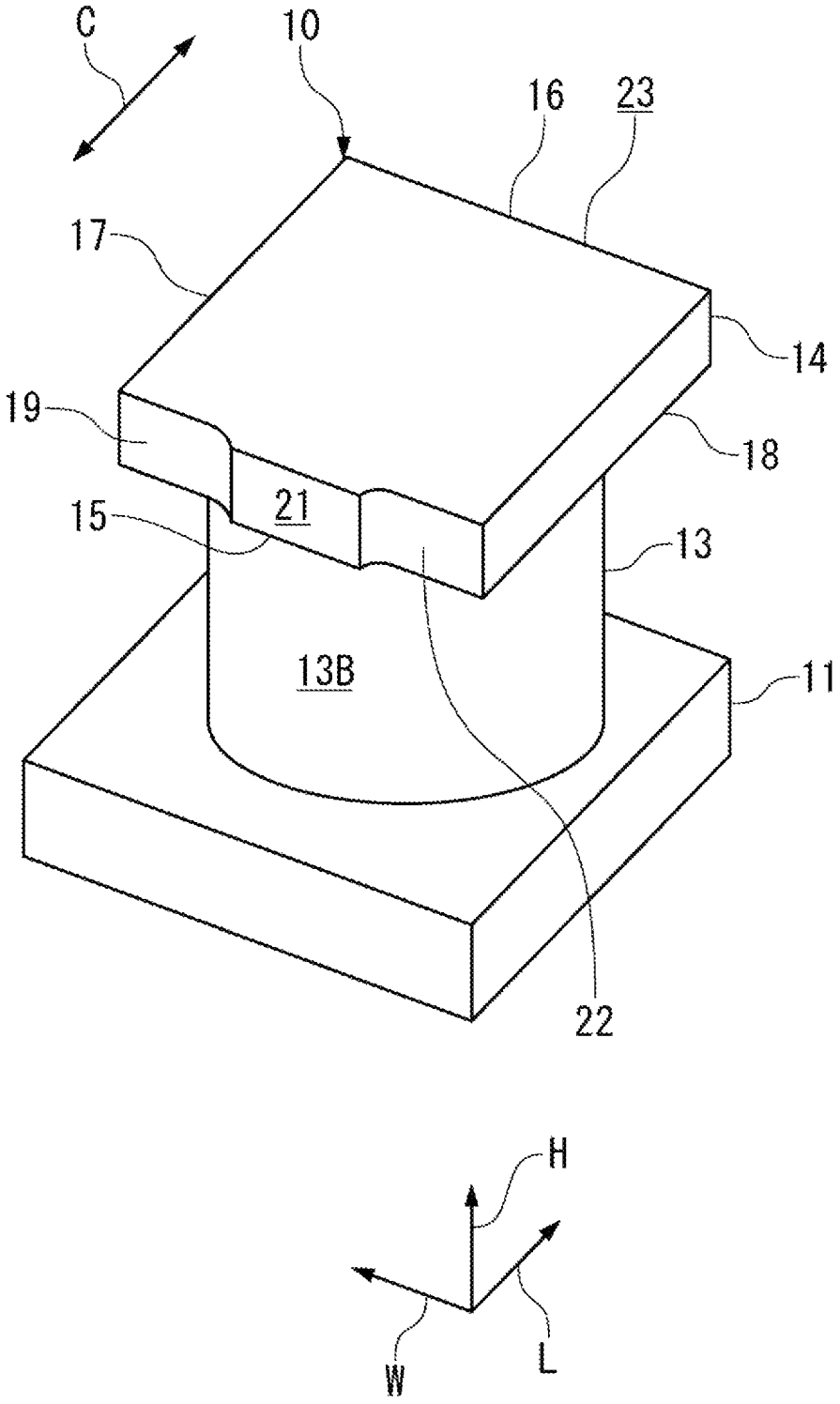
FIG. 3 is a perspective view illustrating a single turbine rotor blade according to the embodiment of the present invention.

FIG. 3 illustrates an example of one turbine rotor blade 10 according to the present embodiment.

The shroud 14 of the turbine rotor blade 10 has a substantially rectangular plate shape and includes a first contact end part 15 and a second contact end part 16 that are disposed with a predetermined interval in a length direction L of the turbine rotor blade assembly 1. Further, the shrouds 14 are provided along the circumferential direction C of the turbine rotor blade assembly 1, each shroud 14 including a first side part 17 and a second side part 18 that are disposed with a predetermined interval in a width direction W. A portion between the first contact end part 15 and the second contact end part 16 forms a main body part of the turbine rotor blade 10. One side of the first contact end part 15 and one side of the second contact end part 16 are connected by the first side part 17, and the other side of the first contact end part 15 and the other side of the second contact end part 16 are connected by the second side part 18.

In the shroud 14, the first contact end part 15 is provided with a first contact surface 21 that comes into contact with the adjacent shroud 14 on one end side in the circumferential direction C during operation. The first contact end part 15 is provided with a first concave part 19 on one side in the width direction W and a second concave part 22, which is recessed from the first contact surface 21, on the other side of the first contact surface 21, that the first contact surface 21 is sandwiched. Accordingly, the first contact surface 21 protrudes more than the other regions. The concave parts 19 and 22 are formed throughout a height direction H. The first contact surface 21 is formed as a flat surface, and has an area smaller than an area of a cross-section of the main body part in the width direction W. The first contact surface 21 is point-symmetrical in the width direction W.

In contrast, the second contact end part 16 is formed as a flat surface. A surface of the second contact end part 16, the surface coming into contact with the first contact end part 15 of the counterpart shroud adjacent to the other end side in the circumferential direction C, is referred to as a second contact surface 23.

Next, effects achieved by the turbine rotor blade assembly 1 according to the present embodiment will be described.

In the turbine rotor blade assembly 1, when the inclined shrouds 14 rise at the time of operation, with respect to the shrouds 14 and 14 to be adjacent to each other, the first contact end part 15 of one of the shrouds and the second contact end part 16 of the other one face each other and come into contact with each other. At this time, the first contact end part 15 is provided with the protruding first contact surface 21, and a part of the second contact end part 16 corresponding to the first contact surface 21 is formed as a flat surface. Accordingly, the first contact surface 21 comes into contact with the second contact surface 23 of the second contact end part 16 in preference to the other parts of the first contact end part 15.

As described above, when the shrouds 14 are used, only a specific region of the first contact end part 15 always comes into contact with the second contact end part 16 of the counterpart in preference to the other regions of the first contact end part 15. This makes it possible to make the contact regions of the plurality of shrouds 14 uniform, and to accordingly eliminate nonuniform contact between the shrouds 14 adjacent to one another. In addition, since the area of the first contact surface 21 is smaller than the area of the cross-section of the main body part of the shroud 14 in the width direction W, it is possible to enhance surface accuracy. As a result, it is possible to suppress nonuniform contact within the range of the first contact surface 21. Moreover, the protruded part provided with the first contact surface 21 on the top end thereof is lower in rigidity than the main body part communicating the protruded part. Accordingly, when the protruded part comes into contact with the contacting shroud 14, the protruded part elastically deforms following the surface feature of the second contact surface 23 of the second contact end part 16 of the counterpart. This also makes it possible to improve uniformity of contact.

On the other hand, a region which contributes to improvement of uniformity of contact is limited to a part of the shroud 14. Accordingly, rigidity as the whole of the shroud 14 is secured, which makes it possible to obtain the necessary contact reactive force through contact with the adjacent shroud 14. In addition, if each of the turbine rotor blades 10 is integrally molded through casting, it is unnecessary to especially add a process of manufacturing the protruding first contact surface 21.

In the present invention, means for limiting the region coming into contact with the adjacent shroud 14 to a partial region of the first contact end part 15 is not limited to the mode illustrated in FIG. 3. As other examples thereof, modes illustrated in FIG. 4A to FIG. 4C could be applied.

Figure 4A:
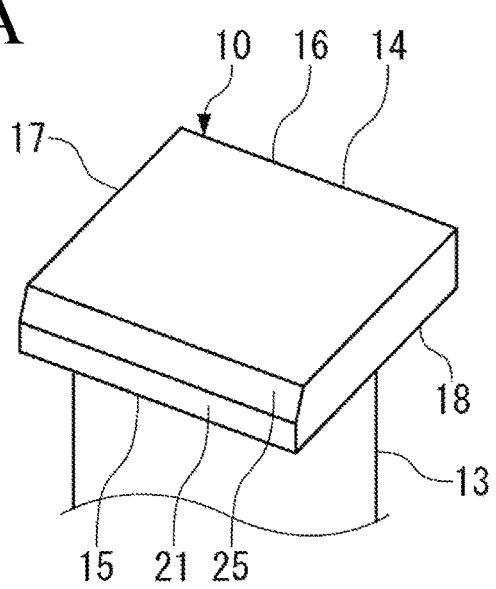
FIG. 4A, FIG. 4B and FIG. 4C are respectively perspective views each illustrating a single turbine rotor blade according to another embodiment of the present invention.
Figure 4B:
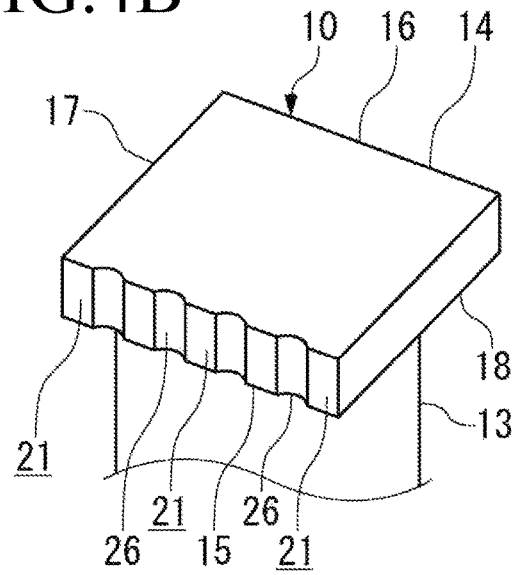
Figure 4C:
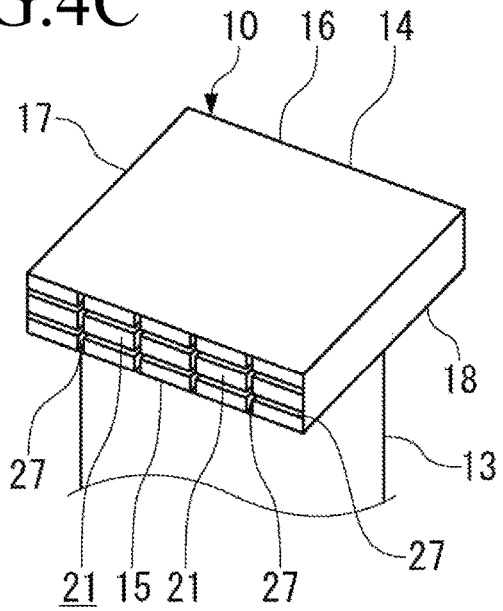
Figure 4C:
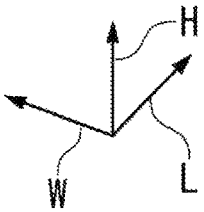

FIG. 4A to FIG. 4C each illustrate the shroud 14 whose planer shape is a rectangular. Among them, FIG. 4A illustrates an example in which because of a recessed part 25 which is provided along the width direction W in a predetermined region of the first contact end part 15 in the height direction H, the first contact surface 21 protrudes more than the other regions. In addition, FIG. 4B illustrates an example in which because of a plurality of recessed parts 26 which are formed in stripes at the first contact end part 15, the first contact surface 21 divided into a plurality of surfaces protrudes more than the other regions. Further, FIG. 4C illustrates an example in which because of recessed parts 27, 27, . . . arranged in a lattice shape which are formed at the first contact end part 15, the first contact surface 21 divided into the plurality of surfaces protrudes more than the other regions.

In any one of FIG. 4A to FIG. 4C, the surface(s) coming into contact with the adjacent shroud 14 is(are) specified and the protruded part(s) is(are) lower in rigidity than the other regions, which results in action and effects similar to those described above.

Note that, as with the example illustrated in FIG. 3, the first contact surface 21 is point-symmetrical in the examples illustrated in FIG. 4B and FIG. 4C, whereas the first contact surface 21 is line-symmetrical in the example illustrated in FIG. 4A. In the present invention, the first contact surface 21 preferably has a symmetrical shape which is a point-symmetrical shape or line-symmetrical shape in the width direction W.

Figure 5B:
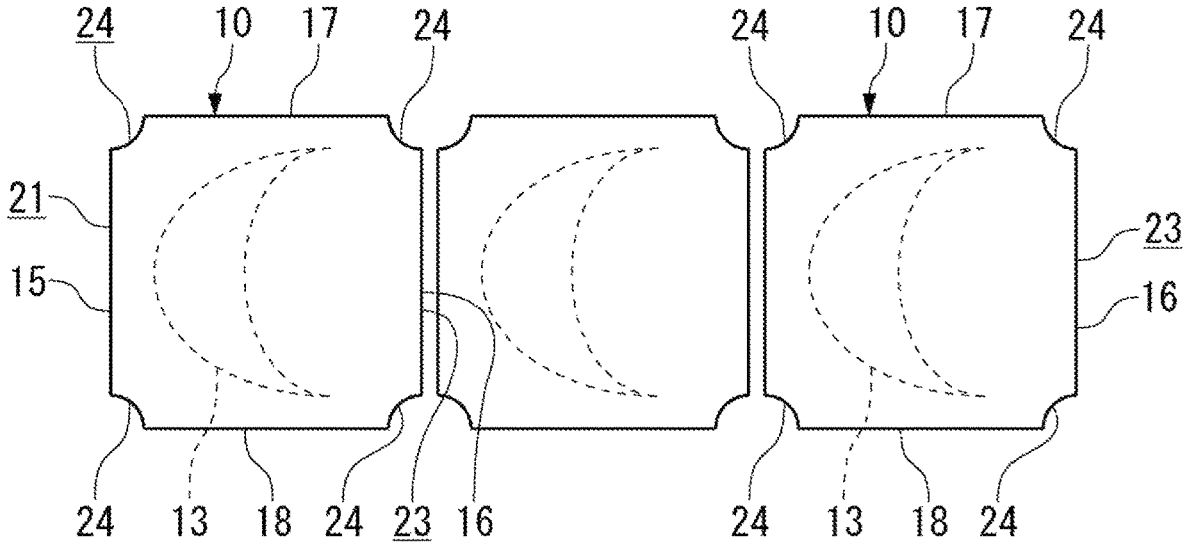

Further, in the embodiment described above, as illustrated in FIG. 5A, a region where the surface coming into contact with the adjacent shroud 14 is specified is provided only in the first contact surface 21 of the first contact end part 15. The surfaces coming into contact with the adjacent shrouds 14, however, may be specified at both of the first contact end part 15 and the second contact end part 16 respectively, as illustrated in FIG. 5B.

Next, another example in which a region coming into contact with the adjacent shroud 14 will be lowered in rigidity is described with reference to FIGS. 6A to 6D and FIGS. 7A to 7C.

Figure 6A:
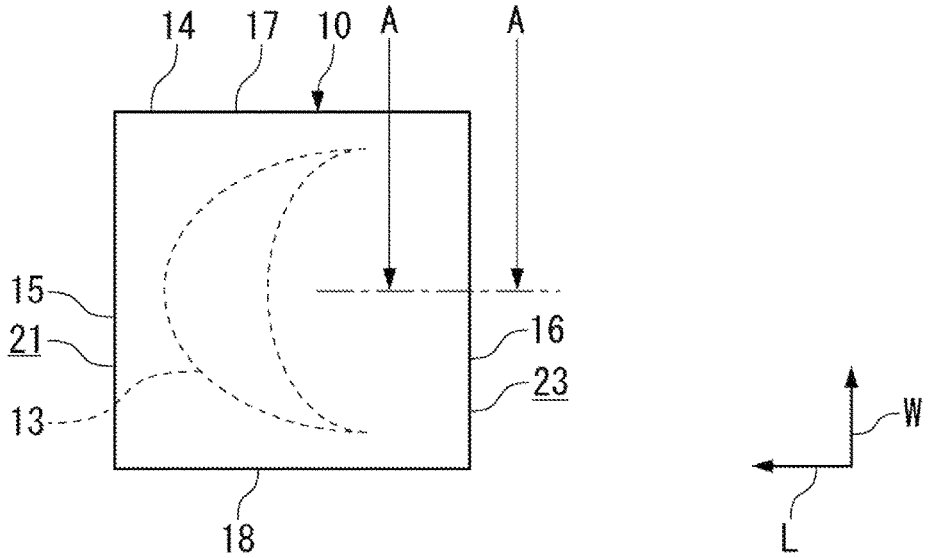
FIG. 6A is a plan view of the turbine rotor blade according to another embodiment of the present invention.

In examples illustrated in FIGS. 6A to 6D, instead of making the area of the first contact surface 21 smaller than the area of the cross-section of the main body part, at least one gap extending in the width direction W of the shroud 14 is formed to provide a thickness-reducing part where the thickness is reduced due to formation of the at least one gap. This lowers rigidity of the thickness-reducing part and facilitates elastic deformation of a part lying on the top end side of the thickness-reducing part. Note that FIG. 6A illustrates a basic configuration of the turbine rotor blade 10 provided with the thickness-reducing part.

Figure 6B:
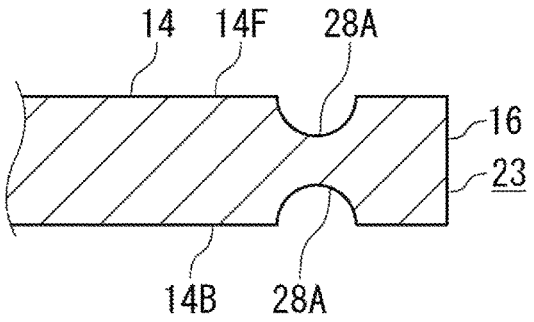
FIG. 6B, FIG. 6C and FIG. 6D are respectively cross-sectional views taken along a line A-A of FIG. 6A of the turbine rotor blade according to the another embodiment of the present invention.

Among them, in FIG. 6B, concave grooves 28A and 28A that continuously extend in the width direction W are respectively formed on a front surface 14F and a rear surface 14B of the shroud 14, to lower the rigidity of a part where the concave grooves 28A and 28A are formed. This allows a part lying on the top end side of the part where the concave grooves 28A and 28A are provided, to elastically deform following the shape of the counterpart when the part comes into contact with the adjacent shroud 14.

Figure 6C:
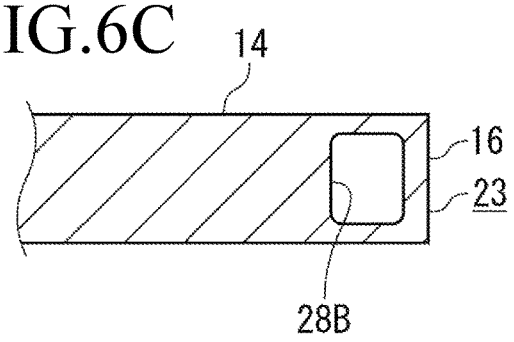
Figure 6D:
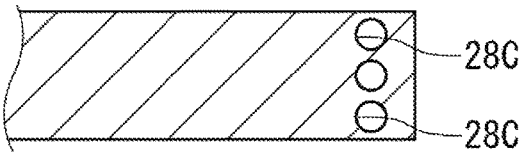

Likewise, in FIG. 6C, a unfilled part 28B that penetratingly extends in the width direction W is provided, which results in action and effects similar to those in FIG. 6B. It is unnecessary to integrally form the unfilled part 28B, and a plurality of divided unfilled parts may be provided as illustrated in FIG. 6D.

Note that the examples of the concave grooves 28A and 28A continuing in the width direction W and the unfilled part 28B penetrating in the width direction W are illustrated here; however, concave grooves or unfilled parts may be intermittently provided along the width direction W in the present invention.

Figure 7A:
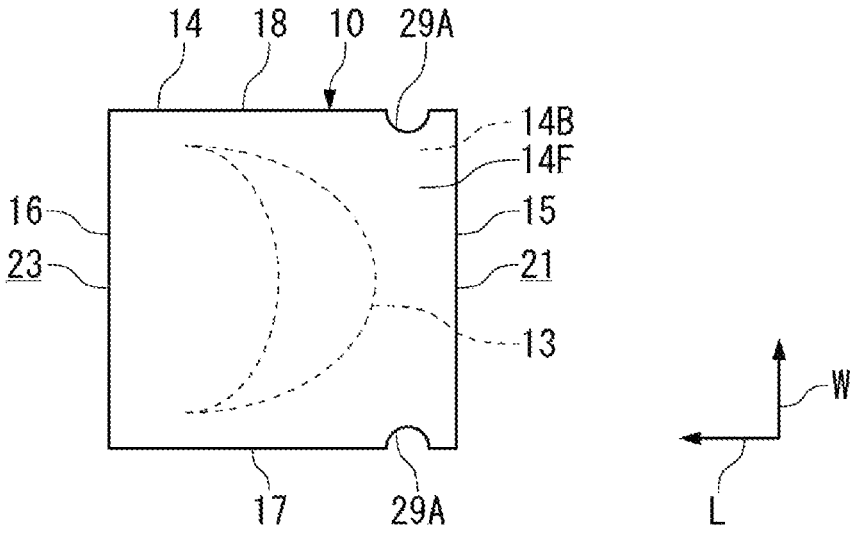
FIG. 7A, FIG. 7B and FIG. 7C are respectively plan views, each illustrating the turbine rotor blade according to another embodiment of the present invention, and illustrate different embodiments from each other.
Figure 7B:
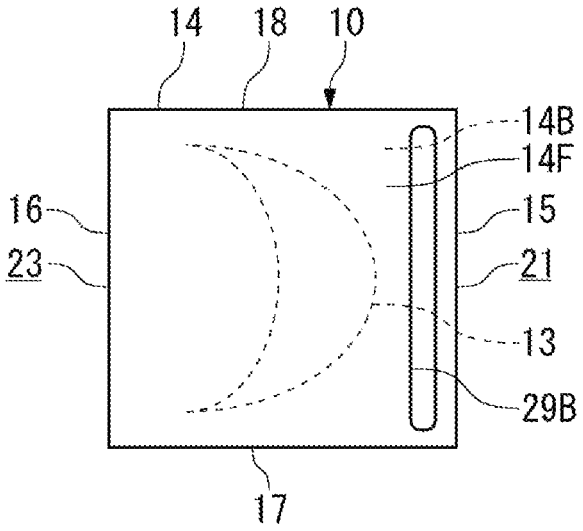
Figure 7C:
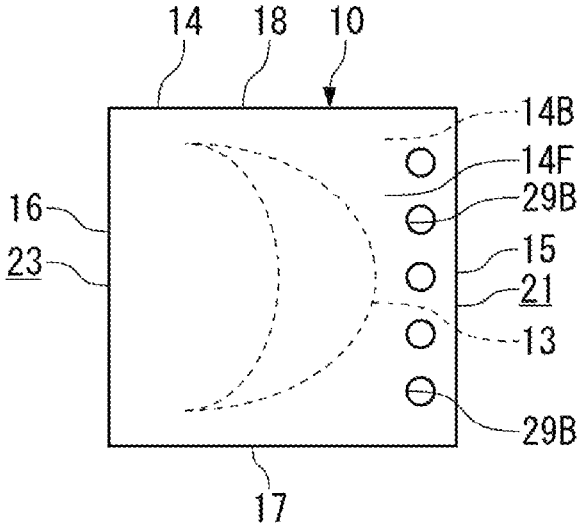

In examples illustrated in FIGS. 7A to 7C, a gap extending in the height direction H of the shroud 14 is formed to reduce a thickness and to lower rigidity of a part where the gap is formed, which facilitates elastic deformation of a part lying on the top end side of the part where the gap is formed.

Among them, in FIG. 7A, concave grooves 29A and 29A that penetratingly extend in the height direction H are formed at both ends of the shroud 14 in the width direction W respectively, thereby lowering rigidity of a part where the concave grooves 29A and 29A are formed. As a result, a part lying on the top end side of the part where the concave grooves 29A and 29A are provided elastically deforms following the surface feature of the contacting shroud when the part comes into contact with the adjacent shroud 14.

Likewise, in FIG. 7B, a through hole 29B that penetratingly extends in the height direction H is formed throughout a region of the shroud 14 except for both ends in the width direction W, thereby lowering rigidity of a part where the through hole 29 is provided. Further, as illustrated in FIG. 7C, the through hole may be divided into a plurality of through holes 29B.

Note that the examples of the concave grooves 29A and 29A penetrating in the height direction H and the through hole 29B penetrating in the height direction H are illustrated here; however, concave grooves or holes may be intermittently provided along the height direction H in the present invention.

As described above, the first contact end part 15 communicates with the main body part through the thickness-reducing part, which facilitates elastic deformation of a part lying on the top end side of the thickness-reducing part.

As described above, also in the shroud 14 illustrated in FIGS. 6A to 6D and FIGS. 7A to 7C, the first contact end part 15 elastically deforms according to the feature of the counterpart, which makes it possible to improve uniformity of contact.

Other than the above, the configurations described in the above-described embodiments may be selected or appropriately modified without departing from the scope of the present invention.

REFERENCE SIGNS LIST

1 Turbine rotor blade assembly
10 Turbine rotor blade
11 Platform
12 Blade root
12A, 12B, 12C Tooth
12D, 12E, 12F Tooth space
13 Profile
13A Belly side part
13B Back side part
14 Shroud
14B Rear surface
14F Front surface
15 First contact end part
16 Second contact end part
17 First side part
18 Second side part
19 First concave part
20 First contact surface
21 Second concave part
22 Second contact surface
24, 25, 26, 27 Recessed part
28A, 29A Concave groove
29B Through hole
30 Turbine disk
31 Blade groove

The invention claimed is:

1. A turbine rotor blade assembly comprising:

a plurality of turbine rotor blades in a circumferential direction of a turbine disk, wherein each of the plurality of turbine rotor blades includes:

a platform having a blade root to be embedded in the turbine disk;

a profile rising from the platform; and a shroud provided at a top end of the profile, the shroud includes:

a first contact end part that contacts an adjacent shroud adjacent to one end side of the shroud in the circumferential direction;

a second contact end part that contacts an another adjacent shroud adjacent to the other end side of the shroud in the circumferential direction; and a main body part disposed between the first contact end part and the second contact end part, the first contact end part has lower rigidity than the main body part, and a surface of the second contact end part opposite to the main body part is flat.

2. The turbine rotor blade assembly according to claim 1, wherein the first contact end part includes a contact surface that protrudes from the main body part in the circumferential direction and contacts the adjacent shroud, and an area of the contact surface is smaller than an area of a cross-section of the main body part in a width direction.

3. The turbine rotor blade assembly according to claim 2, wherein the contact surface is symmetrical in the width direction.

4. The turbine rotor blade assembly according to claim 3, wherein the first contact end part includes concave parts that sandwich the contact surface in the width direction, and the contact surface protrudes from the main body more than the concave parts.

5. The turbine rotor blade assembly according to claim 1, wherein one or both of the first contact end part and the second contact end part communicate with the main body part through a thickness-reducing part.

6. The turbine rotor blade assembly according to claim 5, wherein the thickness-reducing part is formed to extend in the width direction or a height direction.

7. A turbine rotor blade assembly comprising:

a plurality of turbine rotor blades in a circumferential direction of a turbine disk, wherein each of the plurality of turbine rotor blades includes:

a platform having:

a blade root to be embedded in the turbine disk; and a platform main body that is exposed from the turbine disk;

a profile rising from the platform; and a shroud provided at a top end of the profile, the platform main bodies of the plurality of turbine rotor blades are disposed along an outer periphery of the turbine disk in the circumferential direction of the turbine disk, the shroud includes:

a first contact end part that contacts an adjacent shroud adjacent to one end side of the shroud in the circumferential direction;

a second contact end part that contacts an another adjacent shroud adjacent to the other end side of the shroud in the circumferential direction; and a main body part disposed between the first contact end part and the second contact end part, the first contact end part has lower rigidity than the main body part, and a surface of the second contact end part opposite to the main body part is flat.

8. A turbine rotor blade assembly comprising:

a plurality of turbine rotor blades in a circumferential direction of a turbine disk, wherein each of the plurality of turbine rotor blades includes:

a platform having:

a blade root to be embedded in the turbine disk; and a platform main body that is exposed from the turbine disk;

a profile rising from the platform; and a shroud provided at a top end of the profile, the platform main bodies of the plurality of turbine rotor blades are disposed along an outer periphery of the turbine disk in the circumferential direction of the turbine disk, the shroud includes:

a first contact end part that contacts an adjacent shroud adjacent to one end side of the shroud in the circumferential direction;

a second contact end part that contacts an another adjacent shroud adjacent to the other end side of the shroud in the circumferential direction; and a main body part disposed between the first contact end part and the second contact end part, the first contact end part has lower rigidity than the main body part, a surface of the second contact end part opposite to the main body part is flat, the first contact end part includes a contact surface that protrudes from the main body part in the circumferential direction and contacts the adjacent shroud, and an area of the contact surface is smaller than an area of a cross-section of the main body part in a width direction.

* * * * *